US009185494B2

(12) United States Patent
Choi et al.

(10) Patent No.: US 9,185,494 B2
(45) Date of Patent: Nov. 10, 2015

(54) INNER MAGNET TYPE MICROSPEAKER

(71) Applicant: EM-TECH Co., Ltd., Busan (KR)

(72) Inventors: Kyu Dong Choi, Changwon-si (KR); Jong Soo Yoon, Gimhae-si (KR)

(73) Assignee: EM-TECH Co., Ltd., Busan (KR)

( * ) Notice: Subject to any disclaimer, the term of this patent is extended or adjusted under 35 U.S.C. 154(b) by 0 days.

(21) Appl. No.: 14/184,796

(22) Filed: Feb. 20, 2014

(65) Prior Publication Data

US 2014/0241566 A1 Aug. 28, 2014

(30) Foreign Application Priority Data

Feb. 22, 2013 (KR) ..... 10-2013-0019092

(51) Int. Cl.
*H04R 9/04* (2006.01)
*H04R 7/12* (2006.01)

(52) U.S. Cl.
CPC ..... *H04R 9/04* (2013.01); *H04R 9/043* (2013.01); *H04R 7/122* (2013.01)

(58) Field of Classification Search
CPC ..... H04R 9/063; H04R 9/043; H04R 9/045
USPC ..... 381/386, 162, 396, 186, 423, 424, 430, 381/182
See application file for complete search history.

(56) References Cited

U.S. PATENT DOCUMENTS

| | | | | |
|---|---|---|---|---|
| 2006/0078151 | A1 * | 4/2006 | Kemmerer et al. | 381/397 |
| 2013/0016874 | A1 * | 1/2013 | Huang et al. | 381/433 |
| 2013/0156237 | A1 * | 6/2013 | Kim | 381/191 |
| 2014/0119578 | A1 | 5/2014 | Choi et al. | |

FOREIGN PATENT DOCUMENTS

| | | | | |
|---|---|---|---|---|
| EP | 2725820 | A1 * | 4/2014 | |
| JP | 10-285692 | | 10/1998 | |
| KR | 10-1054304 | | 7/2011 | |
| KR | 101187510 | B1 | 10/2012 | |
| KR | WO2012157888 | A2 * | 11/2012 | H04R 9/043 |
| WO | 2009082060 | A1 | 7/2009 | |
| WO | 2011162457 | A1 | 12/2011 | |
| WO | WO 2012157888 | A2 * | 11/2012 | |

* cited by examiner

*Primary Examiner* — Brian Ensey
*Assistant Examiner* — Julie X Dang
(74) *Attorney, Agent, or Firm* — Murphy, Bilak & Homiller, PLLC

(57) ABSTRACT

An inner magnet type microspeaker including a suspension is provided which can maximize the size of a magnet. The inner magnet type microspeaker includes: a frame; a yoke installed inside of the frame and including a bottom surface and sidewalls bent upward from the bottom surface; a magnet bonded to an inside of the yoke; a voice coil located in a gap portion between the sidewalls of the yoke and the magnet; a diaphragm that vibrates by the voice coil; and a suspension where the voice coil is attached, and which guides vibrations of the diaphragm and the voice coil and includes a ring-shaped inner peripheral portion and an outer peripheral portion that surrounds the inner peripheral portion, spaced a predetermined distance apart from the inner peripheral portion, with one end and the other end being connected to the inner peripheral portion.

12 Claims, 7 Drawing Sheets

INNER MAGNET TYPE MICROSPEAKER

PRIORITY CLAIM

The present application claims priority to Korean Patent Application No. 10-2013-0019092 filed on 22 Feb. 2013, the content of said application incorporated herein by reference in its entirety.

TECHNICAL FIELD

The present invention relates to an inner magnet type microspeaker.

BACKGROUND

Microspeakers are classified into inner ring magnet type, outer ring magnet type, inner and outer ring magnet type, and bar magnet type depending on the structure of a magnetic circuit.

FIG. 1 is a view showing a magnetic circuit structure for a conventional inner ring magnet type microspeaker. A magnet 22 is installed on a yoke 21, and a plate 23 is attached to the top of the magnet 22. The magnet 22 is a magnetic circuit which is located inside a voice coil 30 and forms a magnetic path through the yoke 21 and the magnet 22 by folding up the yoke 21 outside the voice coil 30.

FIG. 2 is a view showing a suspension bonding structure for the conventional inner ring magnet type microspeaker. A diaphragm and a protector are omitted in order to clearly show the structure of a suspension 50. The aforementioned magnetic circuit is installed in a frame 10, and the voice coil 30 and the suspension 50, which guides a vibrating body such as a diaphragm to vibrate only vertically without causing partial vibration and abnormal vibration, are seated on the frame 10. The voice coil 30 can be attached to the bottom of the suspension 50, and the diaphragm can be attached selectively to the top or bottom of the suspension 50.

FIG. 3 is a view showing a suspension provided in the conventional inner ring magnet type microspeaker. Referring to FIGS. 2 and 3, the suspension 50 is installed on the frame 10, and includes an outer peripheral portion 51 serving as a substantially rectangular ring-shaped seating end, a substantially rectangular ring-shaped inner peripheral portion 52 located within the outer peripheral portion 51, spaced apart from the outer peripheral portion 51, and a connecting portion 53 that connects the inner peripheral portion 52 and the outer peripheral portion 51 and elastically supports the inner peripheral portion 52. In addition, if necessary, the suspension 50 is formed of a conductive material or FPCB. In this case, the suspension 50 includes a first land portion 54 for connecting to the lead wire of the voice coil 30 and a second land portion 55 for connecting to a terminal 70 installed on the frame 10.

With this suspension structure, the outer periphery of a ring-shaped side diaphragm (not shown), which is seated on the frame 10 and has a predetermined width, is attached to the outer peripheral portion 51, and the inner periphery of the side diaphragm (not shown), the outer periphery of a center diaphragm (not shown), and the voice coil 30 are attached to the inner peripheral portion 52. Referring to the magnetic circuit of FIG. 1, the voice coil 30 should be located in an air gap between the magnet 22 and the folded-up portion of the yoke 21. Accordingly, although the magnet 22 is smaller in size than the inner peripheral portion 52 of the suspension 50, the size of the frame 10, i.e., the overall size of the microspeaker, should be at least equal to or larger than the size of the outer peripheral portion 51 of the suspension 50. Hence, the size of the magnet 22 is limited by the shape of the suspension 50 even if the microspeaker is large in size.

SUMMARY

An object of the present invention is to provide an inner magnet type microspeaker including a suspension, which can maximize the size of a magnet.

The present invention provides an inner magnet type microspeaker including: a frame; a yoke bonded to the inside of the frame and including a bottom surface and sidewalls bent upward from the bottom surface; a magnet bonded to the inside of the yoke; a voice coil located in a gap portion between the sidewalls of the yoke and the magnet; a diaphragm that vibrates by the voice coil; and a suspension where the diaphragm and the voice coil are attached, and which guides vibrations of the diaphragm and the voice coil and includes a ring-shaped inner peripheral portion and an outer peripheral portion that surrounds the inner peripheral portion, spaced a predetermined distance apart from the inner peripheral portion, with one end and the other end being connected to the inner peripheral portion.

According to another aspect of the present invention, the outer peripheral portion includes a seating region seated on the frame and a damping region located further inward than the frame and inducing vibration.

According to another aspect of the present invention, the outer peripheral portion is provided as a pair at positions facing each other.

According to another aspect of the present invention, the frame and the suspension take the shape of a rectangle having a pair of long sides and a pair of short sides, and the seating region is located on the short sides.

According to another aspect of the present invention, the frame and the suspension take the shape of a rectangle having a pair of long sides and a pair of short sides, one end and the other end of the outer peripheral portion that are connected to the inner peripheral portion are formed on sides facing each other, and, of the inner peripheral portion, the sides which are not connected to the outer peripheral portion are larger in width than the sides which are connected to the outer peripheral portion by a predetermined amount.

According to another aspect of the present invention, a land portion for connecting to the lead wire of the voice coil is provided in the larger-width regions of the inner peripheral portion of the suspension.

According to another aspect of the present invention, the frame includes a stepped portion for accommodating the outer peripheral portion of the suspension.

According to another aspect of the present invention, the diaphragm includes a center diaphragm attached to the inner peripheral portion and a ring-shaped side diaphragm attached to the outer peripheral portion and the inner peripheral portion, and the side diaphragm is seated on the frame and the outer peripheral portion of the suspension accommodated in the frame.

According to another aspect of the present invention, of the outer peripheral portion of the suspension, the part which is not accommodated in the stepped portion is smaller in thickness than the part which is accommodated in the stepped portion, and therefore do not come into contact with the side diaphragm.

According to another aspect of the present invention, the diaphragm includes a center diaphragm attached to the inner peripheral portion and a ring-shaped side diaphragm attached to the outer peripheral portion and the inner peripheral portion, and the center diaphragm is attached to the inner peripheral portion of the suspension with a double-sided tape.

Furthermore, the present invention provides an inner magnet type microspeaker including: a frame; a yoke bonded to the inside of the frame and including a bottom surface and sidewalls bent upward from the bottom surface; a magnet bonded to the inside of the yoke; a suspension including an outer peripheral portion seated on the frame, an inner peripheral portion spaced a predetermined distance apart from the outer peripheral portion and located within the outer peripheral portion, and a connecting portion connecting the outer peripheral portion and the inner peripheral portion and elastically supporting the inner peripheral portion; a voice coil located in a gap portion between the sidewalls of the yoke and the magnet; and a diaphragm that vibrates by the voice coil and includes a center diaphragm attached to the inner peripheral portion and a ring-shaped side diaphragm with the inner and outer peripheries attached to the inner and outer peripheral portions, wherein the connecting portion includes a parallel portion that is parallel to the outer peripheral portion and the inner peripheral portion, a first vertical portion connecting the parallel portion and the inner peripheral portion, and a second vertical portion connecting the parallel portion and the outer peripheral portion, and the center diaphragm includes an extension that extends further outward than the inner peripheral portion of the suspension and the outer periphery of the center diaphragm is located between the inner peripheral portion of the suspension and the parallel portion.

According to another aspect of the present invention, the overlapping region between the center diaphragm and the vertical portion is removed in order to prevent interference between the extension and the first vertical portion of the connecting portion.

According to another aspect of the present invention, the suspension includes a land portion for connecting to the lead wire of the voice coil, within the inner peripheral portion, and the overlapping region between the center diaphragm and the land portion is removed.

The inner magnet type microspeaker provided in the present invention can have higher output because the voice coil and the magnet can be enlarged in size by changing the structure of the suspension.

Furthermore, the inner magnet type microspeaker provided in the present invention can have higher output because the voice coil and the magnet can be enlarged in size by attaching the center diaphragm to the bottom of the suspension, including an extension that extends further outward than the inner peripheral portion of the suspension where the center diaphragm is attached, and attaching the voice coil on the extension.

Those skilled in the art will recognize additional features and advantages upon reading the following detailed description, and upon viewing the accompanying drawings.

DETAILED DESCRIPTION

Hereinafter, the present invention will be described in more detail with reference to the drawings.

Figure 1:
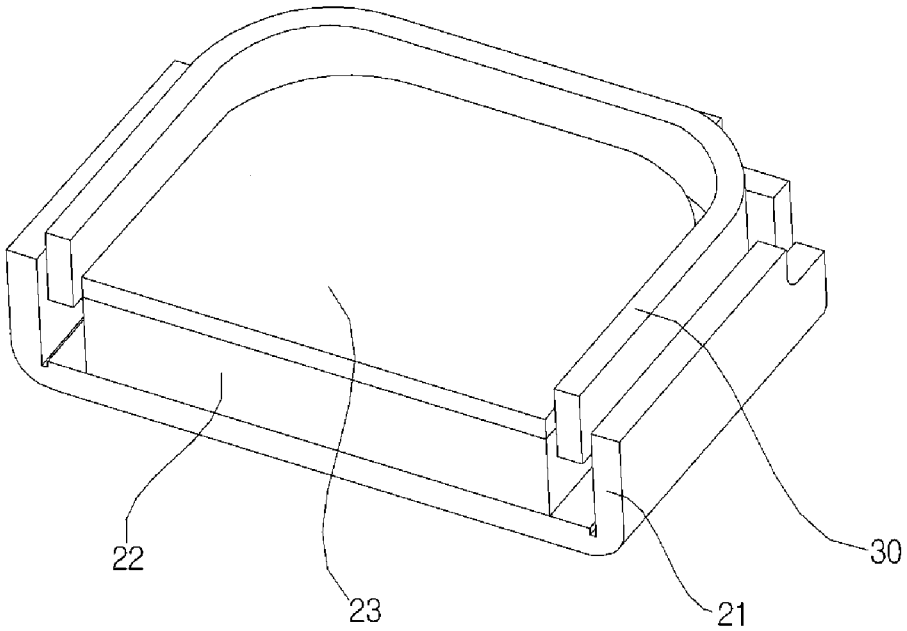
Fig.1 (PRIOR ART)
FIG. 1 is a view showing a magnetic circuit structure for a conventional inner magnet type microspeaker.
Figure 2:
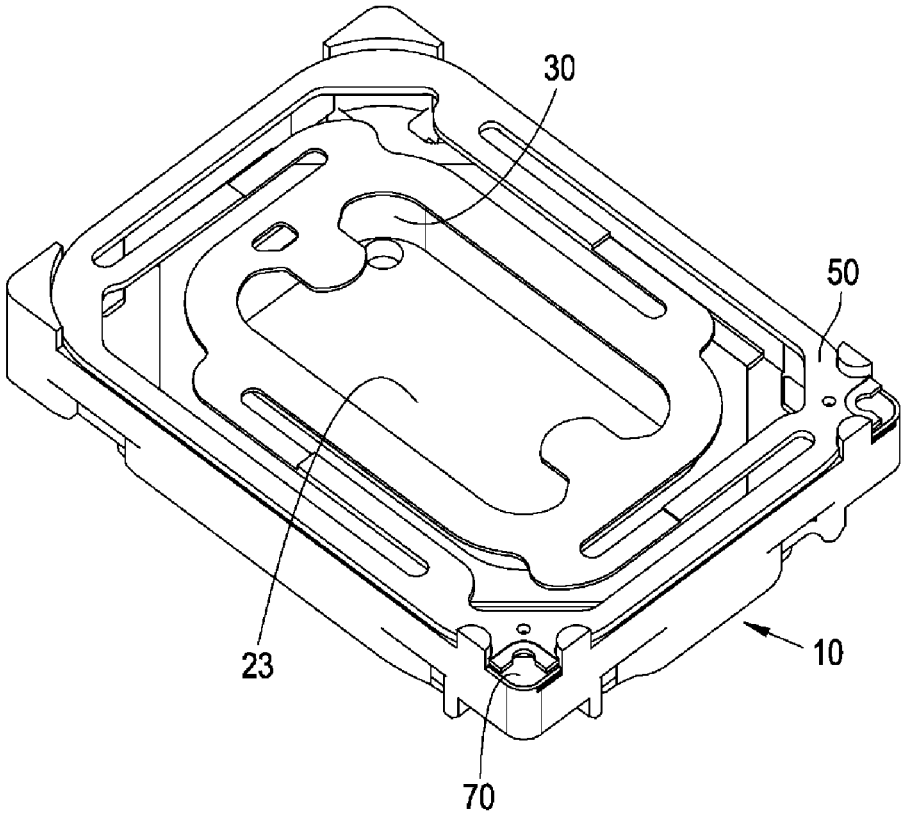
Fig.2 (PRIOR ART)
FIG. 2 is a view showing a suspension bonding structure for the conventional inner magnet type microspeaker.
Figure 3:
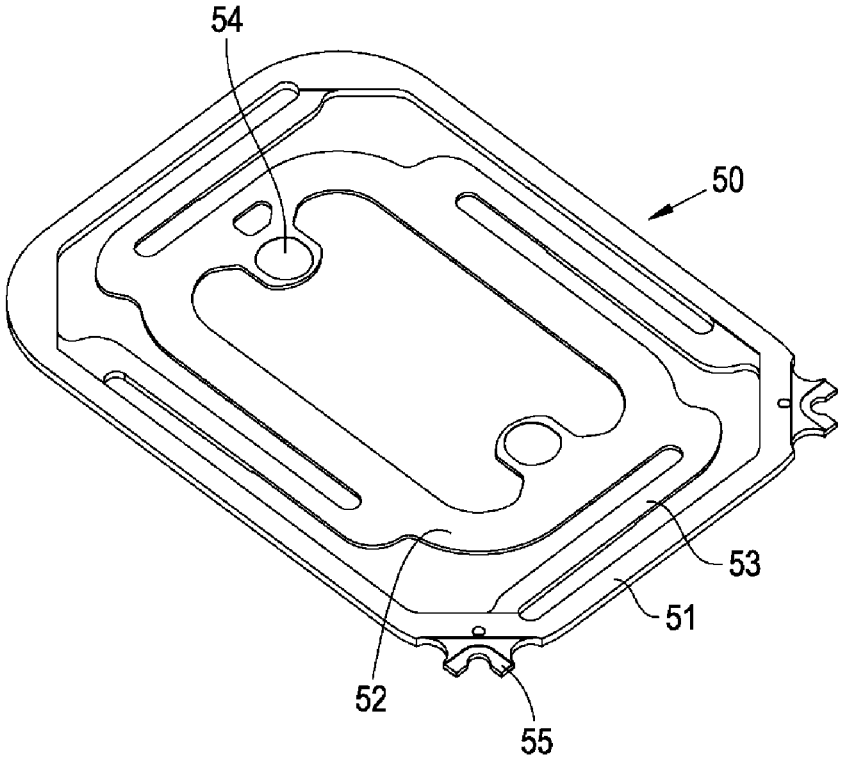
Fig.3 (PRIOR ART)
FIG. 3 is a view showing a suspension provided in the conventional inner magnet type microspeaker.
Figure 4:
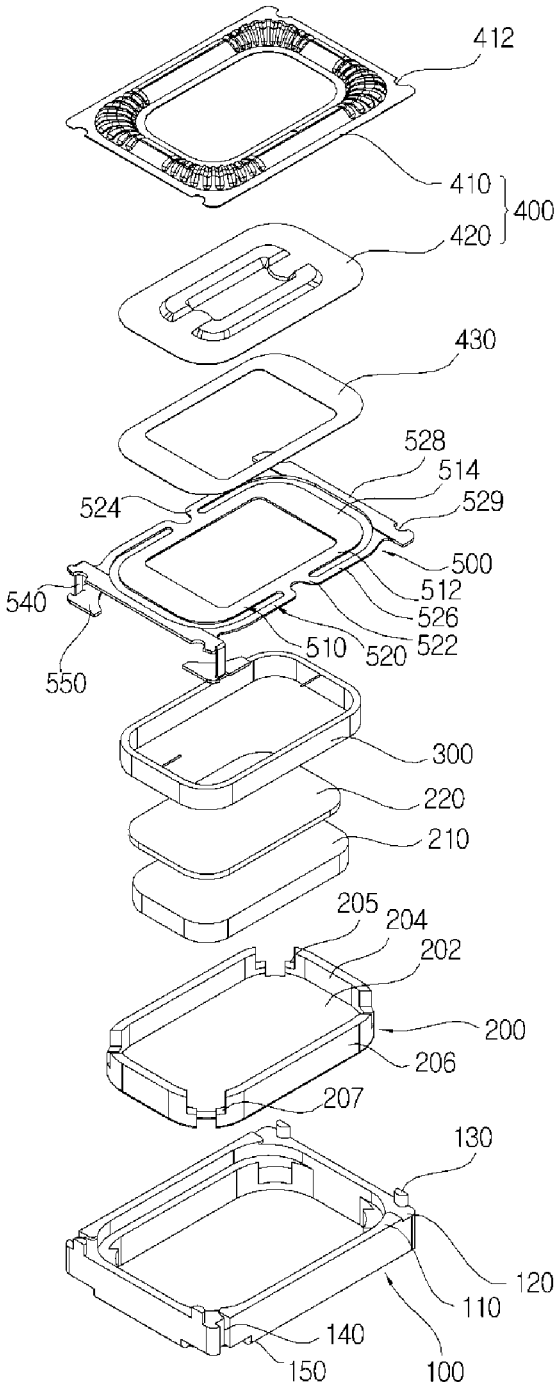
FIG. 4 is an exploded perspective view of an inner magnet type microspeaker according to a first embodiment of the present invention.

FIG. 4 is an exploded perspective view of an inner magnet type microspeaker according to a first embodiment of the present invention. The inner magnet type microspeaker according to the first embodiment of the present invention includes a frame 100, a yoke 200, a magnet 210, a top plate 220, a voice coil 300, a diaphragm 400, and a suspension 500.

The frame 100 provided in the inner magnet type microspeaker according to the first embodiment of the present invention is hollowed out at the top and bottom, and takes the shape of a rectangle having a pair of long sides and a pair of short sides. The frame 100 includes a seating portion 110 where the outer periphery of a side diaphragm 410 is seated, a stepped portion 120, which will be described later, for accommodating a seating region 528 of the outer peripheral portion 520 of the suspension 500, protrusions 130 that protrude upward on the stepped portion 120 to guide the suspension 500 and the side diaphragm 410 to their position, terminal connector accommodating grooves 140, which will be described later, that are formed on one side of the stepped portion 120 by partially removing the outer side of the frame 100 and accommodate terminal connectors 540 of the suspension 500, and terminal accommodating grooves 150, which will be described later, for accommodating terminals 550 of the suspension 500.

The yoke 200 provided in the inner magnet type microspeaker according to the first embodiment of the present invention is assembled within the frame 100, and takes the shape of a rectangle having almost the same length-to-width ratio as the frame 100. The yoke 200 includes a bottom surface 202, and a pair of short sidewalls 204 and a pair of long sidewalls 206 that are bent upward from the bottom surface 202. The corners of the short sidewalls 204 and long sidewalls 206 include stepped parts 205 and 207. The stepped parts 205 and 207 prevent the yoke 200 from being separated from the frame 100 by engaging the frame 100.

A magnet 210 is attached on the bottom surface 202 of the yoke 200, and the top plate 220 is attached to the top surface of the magnet 210. The voice coil 300 is located in a gap portion between the magnet 210 and the short sidewalls 204 and long sidewalls 206 of the yoke 200. Accordingly, when an electric signal is applied to the voice coil 300, a mutual electromagnetic force is generated in a magnetic circuit including the magnet 210 and the yoke 200 and the voice coil 300 therefore vibrates up and down in response to the electric signal.

The diaphragm 400, which vibrates together with the voice coil 300 and produces sound, includes a substantially ring-shaped and dome-like side diaphragm 410 that is hollowed out at the center and a center diaphragm 420 that blocks the hollowed-out center of the side diaphragm 401 and is lightweight and highly rigid.

The suspension 500 provided in the inner magnet type microspeaker according to the first embodiment is rectangular-shaped, and includes a ring-shaped inner peripheral portion 510 that is hollowed out at the center and an outer peripheral portion 520 that surrounds the inner peripheral portion 510, spaced a predetermined distance apart from the inner peripheral portion 510, with one end 522 and the other end 524 being connected to the inner peripheral portion 510. The outer periphery of the center diaphragm 420 and the inner periphery of the side diaphragm 410 are attached to the inner peripheral portion 510. The outer peripheral portion 520 includes a seating region 528 seated on the stepped portion 120 of the frame 100 and a damping region 526 that is located further inward than the seating portion 110 of the frame 100 and elastically supports the inner peripheral portion 510 without being seated on the frame 100. Grooves 529 corresponding to the protrusions 130 of the frame 100 are provided in the seating region 528, by which the seating position of the suspension 500 is determined. As the suspension 500 provided in the inner magnet type microspeaker according to the first embodiment is rectangular-shaped, one end 522 and the other end 524 where the outer peripheral portion 520 and the inner peripheral portion 510 are connected together are respectively located on the long sides facing each other, and the seating region 528 is located on the short sides. Also, while the inner peripheral portion 510 is formed in the shape of one ring, the outer peripheral portion 520 is provided as a pair at positions facing each other.

As with the overall shape of the suspension 500, the inner peripheral portion 510 is rectangular-shaped. As explained above, one end 522 and the other end 524 of the outer peripheral portion 520 are connected as a pair to the center of the long sides 512 of the inner peripheral portion 510 and support the inner peripheral portion 510, which gives the long sides 512 of the inner peripheral portion 510 enough strength to support the inner periphery of the side diaphragm 410, the outer periphery of the center diaphragm 420, and the voice coil 300. On the other hand, the outer peripheral portion 520 is not directly connected to the short sides 514 of the inner peripheral portion 510, so the shorter sides 514 might tilt downward if they have the same width as the long sides 512. To compensate for this, the short sides 514 of the inner peripheral portion 510 are made wider than the long sides 512 by a predetermined amount so as to have enough strength to support the side diaphragm 410, the center diaphragm 420, and the voice coil 300.

The center diaphragm 420 is attached to the inner peripheral portion 510 of the suspension 500 with a double-sided tape 430.

The suspension 500 can be made of FPCB, and serve to transmit an electric signal between the voice coil 300 and an external terminal. To receive an electric signal from the external terminal, the suspension 500 includes the terminal connectors 540 that extends to both sides of the seating region 528 and is accommodated in the terminal connector accommodating grooves 140 of the frame 100, and the terminals 550 that are accommodated in the terminal accommodating grooves 150 in the bottom of the frame 100. In addition, a land portion (not shown) for connecting to the lead wire (not shown) of the voice coil 300 can be provided on the bottom surfaces of the short sides 514, which are larger in width than the long sides 512, of the inner peripheral portion 510 of the suspension 500.

The inner magnet type microspeaker according to the first embodiment is rectangular-shaped, and the stepped portion 120 where the seating region 528 of the outer peripheral portion 520 of the suspension 500 is seated is located on a pair of short sides. However, the protective scope of the invention is not limited thereto and does not exclude embodiments in which the stepped portion 120 is located on a pair of long sides and the seating region 528 of the outer peripheral portion 520 of the suspension 500 is also formed on the long sides or embodiments in which the inner magnet type microspeaker has a circular or elliptical shape.

Figure 5:
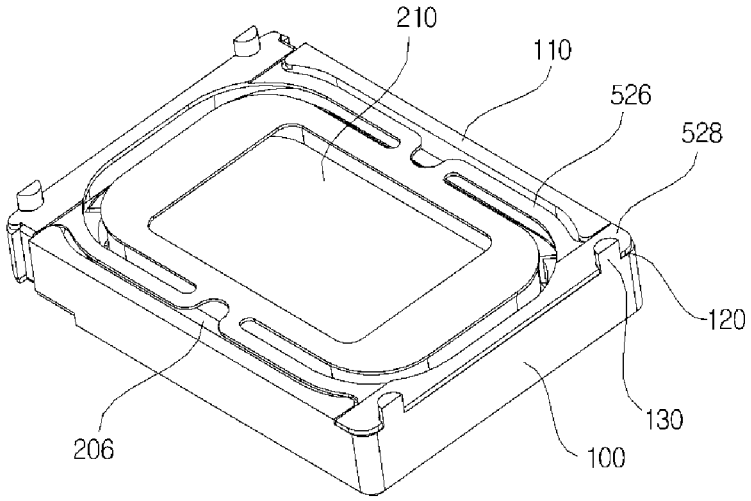
FIG. 5 is a view showing a suspension seating structure for the inner magnet type microspeaker according to the first embodiment of the present invention.

FIG. 5 is a view showing a suspension seating structure for the inner magnet type microspeaker according to the first embodiment of the present invention.

The seating region 528 of the suspension 500 is greater in thickness than the damping region 526. The seating region 528 of the suspension 500 has a predetermined thickness to come up to the same height as the seating portion 110 of the frame 100 when it is accommodated in the stepped portion 120 of the frame 100. Accordingly, some part of the side diaphragm 410 (see FIG. 4) is seated on the seating region 528 accommodated in the stepped portion 120, and some part is seated on the seating portion 110 of the frame 100. Especially, the short sides of the side diaphragm 410 (see FIG. 4) are fully placed on top of the seating region 528.

Because the damping region 526 of the suspension 500 is smaller in thickness than the seating region 528, it does not come into contact with the side diaphragm 410 (see FIG. 4), and the outer periphery of the damping region 526 is made smaller than the inner periphery of the seating portion 110 of the frame 110. Thus, a damping effect can be achieved by vertical movement.

Figure 6:
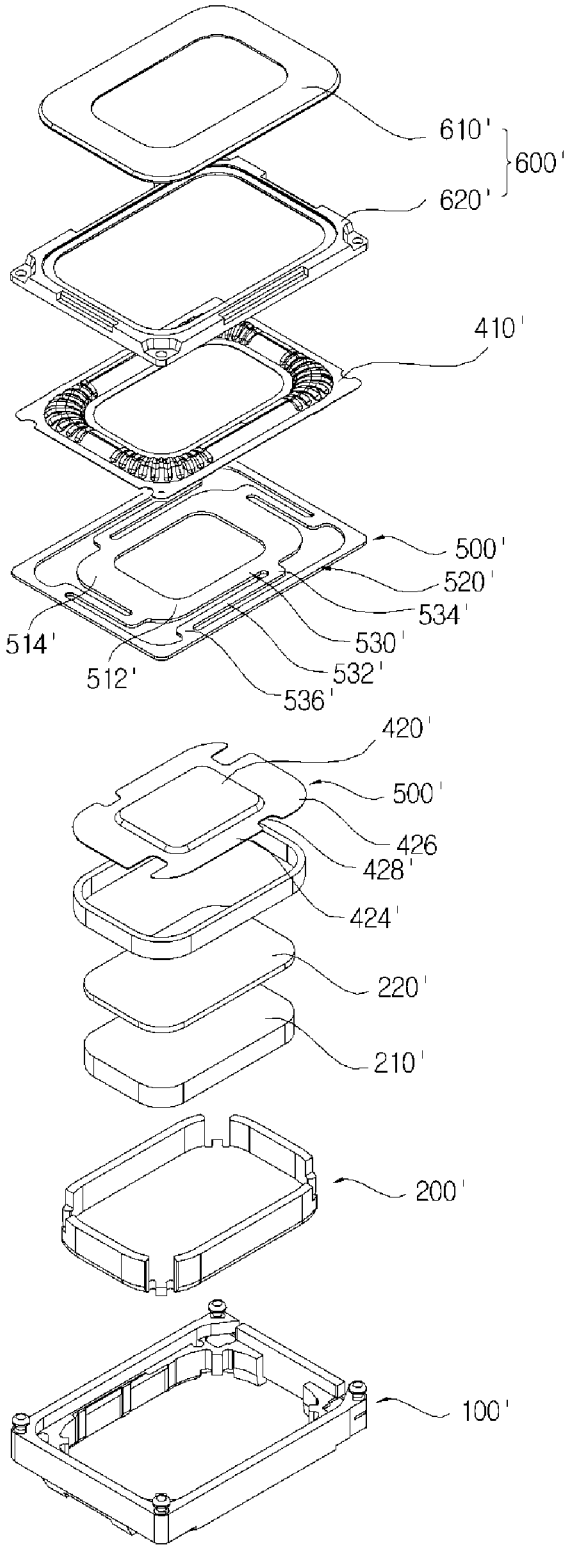
FIG. 6 is a perspective view of an inner magnet type microspeaker according to a second embodiment of the present invention.

FIG. 6 is a perspective view of an inner magnet type microspeaker according to a second embodiment of the present invention. The inner magnet type microspeaker according to the second embodiment of the present invention includes a frame 100', a yoke 200', a magnet 210', a top plate 220', a voice coil 300', a diaphragm 400' (410' and 420'), a suspension 500', and a protector 600' (610' and 620'). The shapes of the frame 100', yoke 200', magnet 210', top plate 220', and voice coil 300 are identical to those of the first embodiment or can be easily modified, so redundant descriptions will be omitted.

The suspension 500' provided in the inner magnet type microspeaker according to the second embodiment of the present invention is seated on the frame 100', and includes a ring-shaped outer peripheral portion 520' that is hollowed out at the center, an inner peripheral portion 510' that is spaced a predetermined distance apart from the outer peripheral portion 520' and located within the outer peripheral portion 520', and a connecting portion 530' that connects the outer peripheral portion 520' and the inner peripheral portion 510' and elastically supports the inner peripheral portion 510'. The connecting portion 530' includes a parallel portion 532' that is parallel to the outer peripheral portion 520' and the inner peripheral portion 510', a first vertical portion 534' connecting the parallel portion 532' and the inner peripheral portion 510', and a second vertical portion 536' connecting the parallel portion 532' and the outer peripheral portion 520. As the microspeaker is rectangular-shaped, the suspension 500' and the inner and outer peripheral portions 510' and 520' of the suspension 500' are also rectangular-shaped. Accordingly, the inner peripheral portion 510' of the suspension 500' includes a pair of long sides 512' facing each other and a pair of short sides 514' facing each other. The suspension 510' can be made of FPCB, and receive a signal from an external power source and transmit it to the voice coil 300'. In this case, the short sides 514' are made wider than the long sides 512' in order to provide a land portion (not shown) for connecting to the lead wire (not shown) of the voice coil 300'.

The center diaphragm 420' is attached to the bottom of the suspension 500', and the attachment position corresponds to the inner peripheral portion 510' of the suspension 500'. The center diaphragm 420' includes an upward protruding dome portion 422' at the center, and the edge of the dome portion 422' corresponds to an attachment portion 424' attached to the inner peripheral portion 510' of the suspension 500'. In addition, the center diaphragm 420' includes an extension 426' that extends further outward than the attachment portion 424'. Since the attachment portion 424' is attached to the inner peripheral portion 510', the outer periphery of the extension 426 is naturally located further outward than the inner peripheral portion 510' of the suspension 500'.

The center diaphragm 420' includes a first removed portion 428' from which the overlapping region between the extension 426' and the first vertical portion 534' of the connecting portion 530' is removed, in order to prevent interference with the connecting portion 530' of the suspension 500' during vertical vibration caused by vibration of the voice coil 300'.

Figure 7:
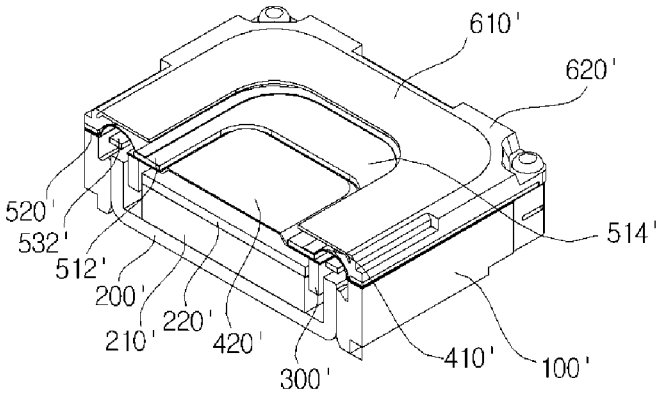
FIG. 7 is a cross-sectional view of the inner magnet type microspeaker according to the second embodiment of the present invention.

FIG. 7 is a cross-sectional view of the inner magnet type microspeaker according to the second embodiment of the present invention. Referring to FIG. 7, the voice coil 300' is attached not to the inner peripheral portion 510' of the suspension 500' but across the inner peripheral portion 510' of the suspension 500' and the extension 426' of the center diaphragm 420'. Accordingly, the attachment position of the voice coil 300' extends further outward, thus enlarging the size of the voice coil 300' and the size of the magnet 210'.

Figure 8:
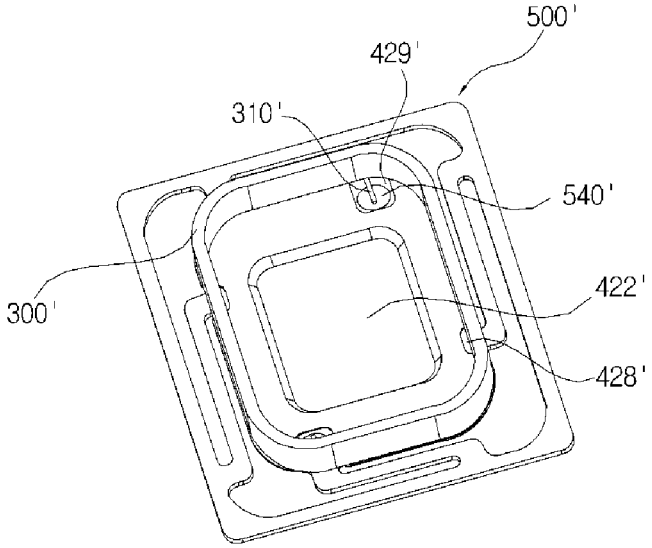
FIG. 8 is a view showing a suspension and voice coil connecting structure for the inner magnet type microspeaker according to the second embodiment of the present invention.

FIG. 8 is a view showing a suspension and voice coil connecting structure for the inner magnet type microspeaker according to the second embodiment of the present invention. Referring to FIG. 8, the suspension 500' includes a land portion 540' on the short sides 514' of the inner peripheral portion 510'. The short sides 514' are made wider than the long sides 512' in order to provide the land portion 540'. In the inner magnet type microspeaker according to the second embodiment of the present invention, the center diaphragm 420' should not block the land portion 540' because the center diaphragm 420' is attached to the bottom surface of the suspension 500' and the voice coil 300' is attached to the bottom of the center diaphragm 420'. Accordingly, the center diaphragm 420' includes a second removed portion 429' from which the overlapping region between the center diaphragm 540' and the land portion 540' is removed. The second removed portion 429' allows the land portion 540' to be exposed, and the lead wire 310' of the voice coil 300' is connected to the exposed land portion 540'. Spatially relative terms such as "under", "below", "lower", "over", "upper" and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising" and the like are open-ended terms that indicate the presence of stated elements or features, but do not preclude additional elements or features. The articles "a", "an" and "the" are intended to include the plural as well as the singular, unless the context clearly indicates otherwise.

With the above range of variations and applications in mind, it should be understood that the present invention is not limited by the foregoing description, nor is it limited by the accompanying drawings. Instead, the present invention is limited only by the following claims and their legal equivalents.

What is claimed is:

1. An inner magnet type micro-speaker, comprising: a frame;

a yoke installed inside of the frame and comprising a bottom surface and sidewalls bent upward from the bottom surface;

a magnet bonded to an inside of the yoke;

a voice coil located in a gap portion between the sidewalls of the yoke and the magnet;

a diaphragm that vibrates by the voice coil; and a suspension where the diaphragm and the voice coil are attached, and which guides vibrations of the diaphragm and the voice coil and comprises a ring-shaped inner peripheral portion and an outer peripheral portion that surrounds the inner peripheral portion, spaced a predetermined distance apart from the inner peripheral portion, with one end and another end being connected to the inner peripheral portion, wherein the frame comprises a stepped portion for accommodating the outer peripheral portion of the suspension, wherein the diaphragm comprises a center diaphragm attached to the inner peripheral portion and a ring-shaped side diaphragm attached to the outer peripheral portion and the inner peripheral portion, and the side diaphragm is seated on the frame and the outer peripheral portion of the suspension is accommodated in the frame, wherein, of the outer peripheral portion of the suspension, the part which is not accommodated in the stepped portion is smaller in thickness than the part which is accommodated in the stepped portion, and therefore does not come into contact with the side diaphragm.

2. The inner magnet type microspeaker of claim 1, wherein the outer peripheral portion comprises a seating region seated on the frame and a damping region located further inward than the frame and guiding vibration.

3. The inner magnet type microspeaker of claim 2, wherein the outer peripheral portion is provided as a pair at positions facing each other.

4. The inner magnet type microspeaker of claim 3, wherein the frame and the suspension take the shape of a rectangle having a pair of long sides and a pair of short sides, and the seating region is located on the short sides.

5. The inner magnet type microspeaker of claim 3, wherein the frame and the suspension take the shape of a rectangle having a pair of long sides and a pair of short sides, one end and the other end of the outer peripheral portion that are connected to the inner peripheral portion are formed on sides facing each other, and, of the inner peripheral portion, the sides which are not connected to the outer peripheral portion are larger in width than the sides which are connected to the outer peripheral portion by a predetermined amount.

6. The inner magnet type microspeaker of claim 5, wherein a land portion for connecting to a lead wire of the voice coil is provided in the larger-width regions of the inner peripheral portion of the suspension.

7. The inner magnet type microspeaker of claim 1, wherein the diaphragm comprises a center diaphragm attached to the inner peripheral portion and a ring-shaped side diaphragm attached to the outer peripheral portion and the inner peripheral portion, and the center diaphragm is attached to the inner peripheral portion of the suspension with a double-sided tape.

8. An inner magnet type micro-speaker, comprising: a frame;

a yoke installed inside of the frame and comprising a bottom surface and sidewalls bent upward from the bottom surface; a magnet bonded to an inside of the yoke; a suspension comprising an outer peripheral portion seated on the frame, an inner peripheral portion spaced a predetermined distance apart from the outer peripheral portion and located within the outer peripheral portion, and a connecting portion connecting the outer peripheral portion and the inner peripheral portion and elastically supporting the inner peripheral portion; a voice coil located in a gap portion between the sidewalls of the yoke and the magnet; and a diaphragm that vibrates by the voice coil and comprises a center diaphragm attached to the inner peripheral portion and a ring-shaped side diaphragm with the inner and outer peripheries attached to the inner and outer peripheral portions, wherein the connecting portion comprises a parallel portion that is parallel to the outer peripheral portion and the inner peripheral portion, a first vertical portion connecting the parallel portion and the inner peripheral portion, and a second vertical portion connecting the parallel portion and the outer peripheral portion, and the center diaphragm comprises an extension that extends further outward than the inner peripheral portion of the suspension and the outer periphery of the center diaphragm is located between the inner peripheral portion of the suspension and the parallel portion, wherein the overlapping region between the center diaphragm and the vertical portion is removed so as to prevent interference between the extension and the first vertical portion of the connecting portion.

9. The inner magnet type microspeaker of claim 8, wherein the voice coil is attached across the inner peripheral portion of the suspension and the extension of the center diaphragm.

10. The inner magnet type microspeaker of claim 8, wherein the suspension comprises a land portion for connecting to the lead wire of the voice coil, within the inner peripheral portion.

11. An inner magnet type micro-speaker, comprising:

a frame;

a yoke installed inside of the frame and comprising a bottom surface and sidewalls bent upward from the bottom surface;

a magnet bonded to an inside of the yoke;

a suspension comprising an outer peripheral portion seated on the frame, an inner peripheral portion spaced a predetermined distance apart from the outer peripheral portion and located within the outer peripheral portion, and a connecting portion connecting the outer peripheral portion and the inner peripheral portion and elastically supporting the inner peripheral portion;

a voice coil located in a gap portion between the sidewalls of the yoke and the magnet; and a diaphragm that vibrates by the voice coil and comprises a center diaphragm attached to the inner peripheral portion and a ring-shaped side diaphragm with the inner and outer peripheries attached to the inner and outer peripheral portions, wherein the connecting portion comprises a parallel portion that is parallel to the outer peripheral portion and the inner peripheral portion, a first vertical portion connecting the parallel portion and the inner peripheral portion, and a second vertical portion connecting the parallel portion and the outer peripheral portion, and the center diaphragm comprises an extension that extends further outward than the inner peripheral portion of the suspension and the outer periphery of the center diaphragm is located between the inner peripheral portion of the suspension and the parallel portion, wherein the suspension comprises a land portion for connecting to the lead wire of the voice coil, within the inner peripheral portion, and the overlapping region between the center diaphragm and the land portion is removed.

12. The inner magnet type microspeaker of claim 11, wherein the voice coil is attached across the inner peripheral portion of the suspension and the extension of the center diaphragm.

* * * * *